United States Patent [19]

Haüser

[11] 4,274,214

[45] Jun. 23, 1981

[54] IRONING TABLE

[75] Inventor: Georg Haüser, Munich, Fed. Rep. of Germany

[73] Assignee: J. Strobel & Sohne GmbH & Co., Munich, Fed. Rep. of Germany

[21] Appl. No.: 948,441

[22] Filed: Oct. 4, 1978

[30] Foreign Application Priority Data

Oct. 4, 1977 [DE] Fed. Rep. of Germany ..... 2744507

[51] Int. Cl.[3] ..... D06F 69/00

[52] U.S. Cl. ..... 38/1 C; 38/14

[58] Field of Search ..... 38/1 C, 1 D, 14, 103, 38/104

[56] References Cited

U.S. PATENT DOCUMENTS

| | | | |
|---|---|---|---|
| 1,900,596 | 3/1933 | Whitney | 38/1 C |
| 2,331,028 | 10/1943 | Gayring | 38/1 C |
| 2,341,689 | 2/1944 | Bryson | 38/1 C |

FOREIGN PATENT DOCUMENTS

| | | |
|---|---|---|
| 2203039 | 7/1973 | Fed. Rep. of Germany . |
| 2456881 | 8/1976 | Fed. Rep. of Germany . |

*Primary Examiner*—Louis Rimrodt

*Attorney, Agent, or Firm*—Stevens, Davis, Miller & Mosher

[57] ABSTRACT

An apparatus for pressing cloth with a heated iron has a surface for supporting a cloth or other material to be pressed, one or more fans for moving air over the ironing surface by suction or by blowing and a switch for controlling electricity that drives the fan. The switch has a first capacitor which is disposed below and in front of the ironing surface. The switch is shaped to the outline of the ironing surface. A second capacitor having a semi-cylindrical cross-section is disposed between the first capacitor and the ironing surface.

16 Claims, 15 Drawing Figures

IRONING TABLE

The invention relates to an ironing table with at least one fan for applying suction and/or blowing on the ironing surface and with at least one switch, operable by the operating personnel for electrically controlling the fan.

Ironing tables of this kind are known with various forms and arrangements of the ironing surface, according to the goods to be ironed, and also they are known with additional ironing hoods of the widest possible range of shapes, which can be detachably mounted on the upper pivoting arms of the ironing tables. Also belonging to the state of the art, it is known to provide ironing tables of the kind under discussion with a pedestal which contains at least one fan and the electrical equipment and with which an upper ironing plate and/or ironing hood is easily detachably connected so that it can be rapidly replaced in order to have available the ironing surface of the currently required shape. In particular for ironing arms and legs ironing tables are further known having two horizontal ironing mandrels which are individually rotatable about the respective longitudinal axis or in common about a central longitudinal axis and can be locked in the required angular position.

As a rule the ironing tables are formed as suction ironing tables and provided with at least one fan which draws off from the respective ironing surface the steam which occurs during ironing or is used where the iron of the respective ironing table is exposed to water or water vapour. However, in many cases it is also desired to blow on the ironing surface, for example in order to be able to remove the ironed goods more easily from the respective ironing surface after ironing. Such ironing tables therefore have at least one fan of which the delivery side is connected to the or each ironing surface of the table in question. Furthermore ironing tables are known in which a suction or blowing operation can be selected at will, and for this purpose either separate blowers for sucking or blowing on the ironing surface are provided or alternatively one or more blowers effective both for sucking and also blowing operation and means for changing over the or each blower between sucking and blowing on the ironing surface.

In particular in large area ironing tables which for example are used for ironing curtains and the like, several fans are connected to the hollow ironing surface in order to achieve as uniform as possible strong action over the whole of the ironing surface. However it is also known, instead of this, to sub-divide the hollow ironing plate or the ironing surface into a number of suction or blowing regions which are capable of connection individually to the same fan for sucking or blowing so that there is always suction or blowing over that region in which the actual ironing is taking place (German OS No. 2 456 881).

In all these known ironing tables the processes which take place in operation are controlled through switches which have to be operated by the operating personnel. For example the switching on and off of the fan is done by means of a switch operated by a foot treadle and the switching over between suction and blowing operation is effected by means of a knee-operated switch and in the abovementioned ironing table that has two horizontal ironing mandrels, a foot treadle switch which is also provided for rotating them. A particular drawback has been found in the fact that the operating personnel must perform a particular switching operation and also the exercise of a certain degree of force is still required and that in most cases the switching member that is to be actuated must remain continuously held, restricting the freedom of movement of the operating personnel to a significant extent. Also one must bear in mind that all this takes place relatively frequently during operation. Finally care must be taken that the frequently relatively long foot treadles are as stiff as possible to resist twisting.

Accordingly the invention is based on the requirement in particular of avoiding these drawbacks and allowing the necessary switching processes on operation of an ironing table of the kind stated to be performed more simply and more comfortably for the operating personnel. This problem is solved by the features given in the characterising part of the main claim. Advantageous embodiments of the invention are characterised in the remaining claims.

In the ironing table according to the invention at least the most important or the most frequently arising functions are controlled by a capacitative proximity switch having a switching arm so that the proximity switch changes over when the operator approaches the arm. By means of the potentiometer which is advantageously associated with the capacitative proximity switch, the sensitivity of the proximity switch can be adjusted so that it changes over on the appropriate desired degree of approach, for example only when the operator comes into contact with the switch arm. This can be constructed and arranged without difficulty so that the freedom of movement of the operator during ironing is not interfered with, even in ironing tables with a large and/or undulating shape of ironing surface. The operator therefore needs neither to watch out in particular that the proximity switch remains actuated, nor to exert any particular operating force.

Also a version is possible in which the respective function remains effective as long as the associated proximity switch is engaged by the operator and also one in which the function is initiated on a first actuation of the proximity switch and is terminated by a second actuation of it. This is for example possible straight away by appropriate choice and construction of the relay or relays which are preferably connected to the capacitative proximity switch. Disturbances of the operation of the capacitative proximity switch by the goods being ironed or by the clothing of the operating personnel are no problem and in particular they are completely eliminated if the switching arm is provided with a shield which exposes only the operative face, that is to say, that face of the arm which is towards the operating personnel working at the table.

Some embodiment of the ironing table according to the invention are described in the following by way of example in conjunction with the drawing. In the drawing, shown diagramatically and partially cut-away:

Figure 15:
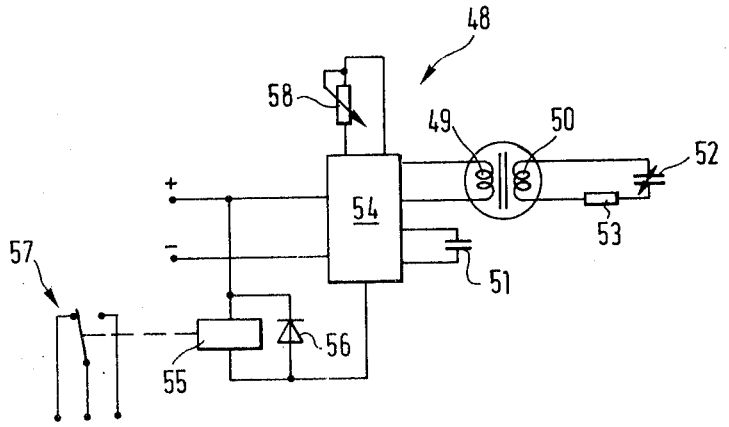
Figure 11:
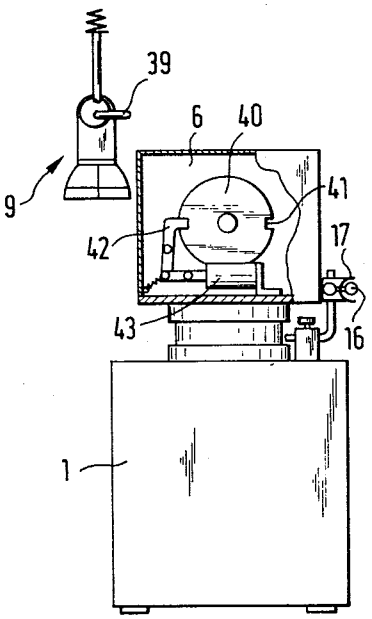
Figure 9:
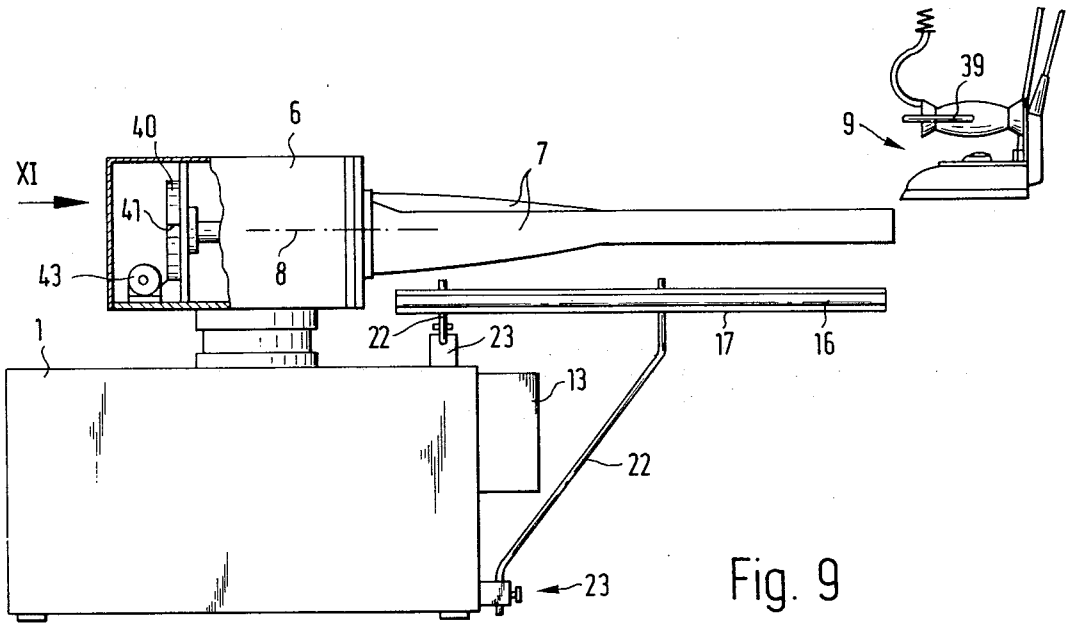
Figure 10:
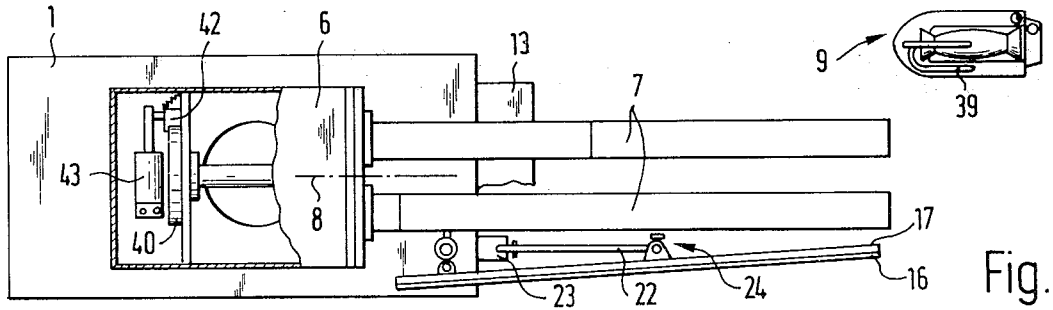
Figure 14:
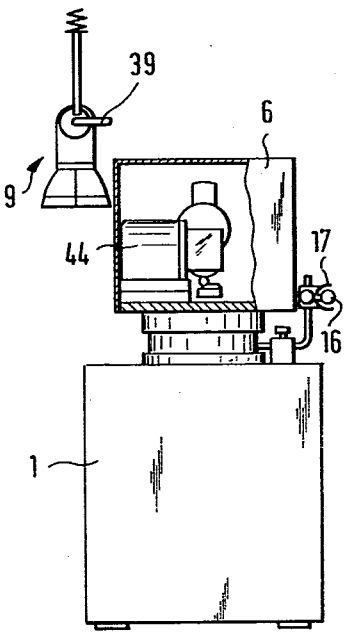
Figure 12:
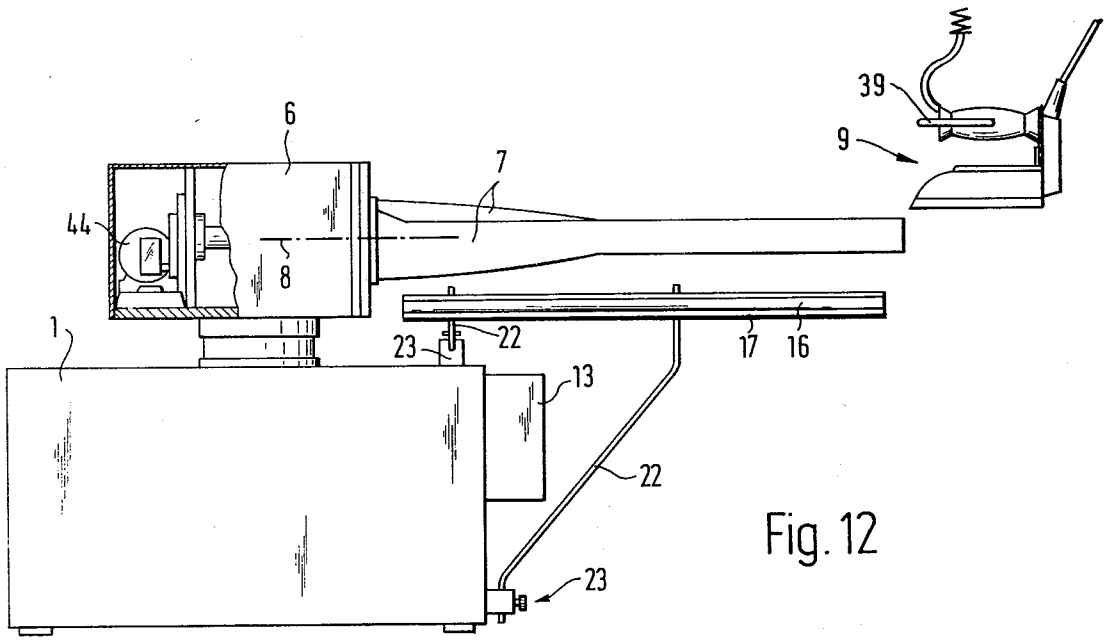
Figure 13:
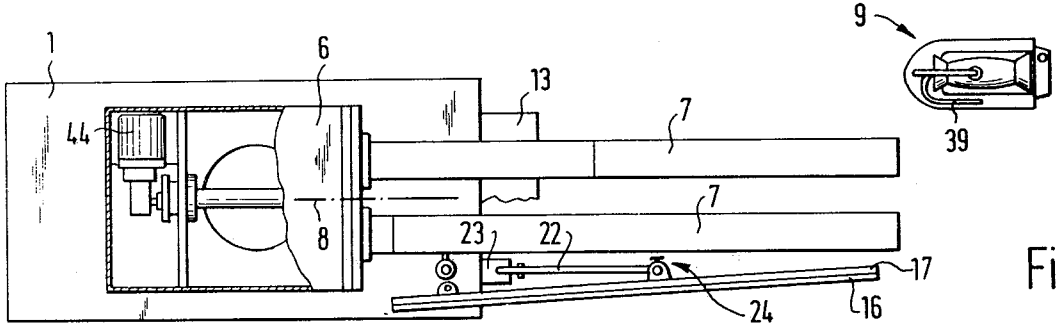

FIGS. 9 to 11 show respectively a front view, a plan view and a side view looking in the direction of the arrow XI in FIG. 9 of an ironing table with two horizontal ironing mandrels which are rotatable together about a central longitudinal axis; and FIGS. 12 to 14 are views corresponding to FIGS. 9, 10 and 11 but showing a modification; whilst FIG. 15 shows the circuit of a capacitative proximity switch capable of use according to the invnetion.

In all the embodiments illustrated the ironing table has a pedestal 1 which, in the embodiments of FIGS. 1 to 8, carries an upper flat hollow ironing plate 2 with an ironing surface 3. Whereas in the embodiments of FIGS. 1 to 5 the plate 2 is mounted to be easily detachable on the pedestal 1 by means of a central tubular support 4, in the embodiments of FIGS. 6 to 8 a hollow intermediate box 5 is provided between the plate 2 and the pedestal 1. In the embodiments of FIGS. 9 to 14 the pedestal 1 carries a structure 6 with two horizontal mutually parallel ironing mandrels 7 which are rotatable together about a central longitudinal axis 8 as explained later and offer an ironing surface over the respective periphery. The ironing is done with an iron 9 associated with the table in question and illustrated only in FIGS. 1, 3 and 9 to 14.

Figure 1:
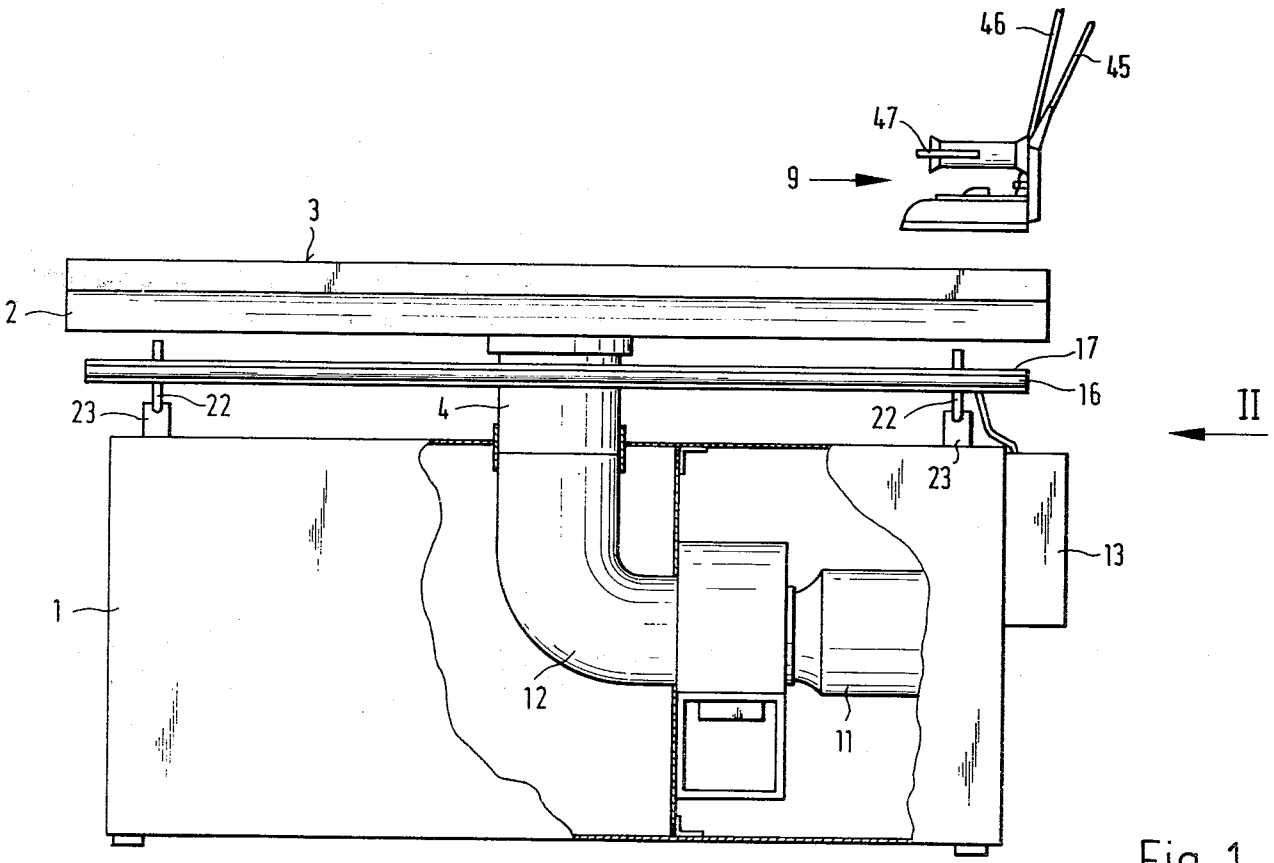
FIGS. 1 and 2 show respectively a front elevation and a side elevation looking in the direction of the arrow II in FIG. 1 of a simple suction ironing table with a flat ironing surface.
Figure 2:
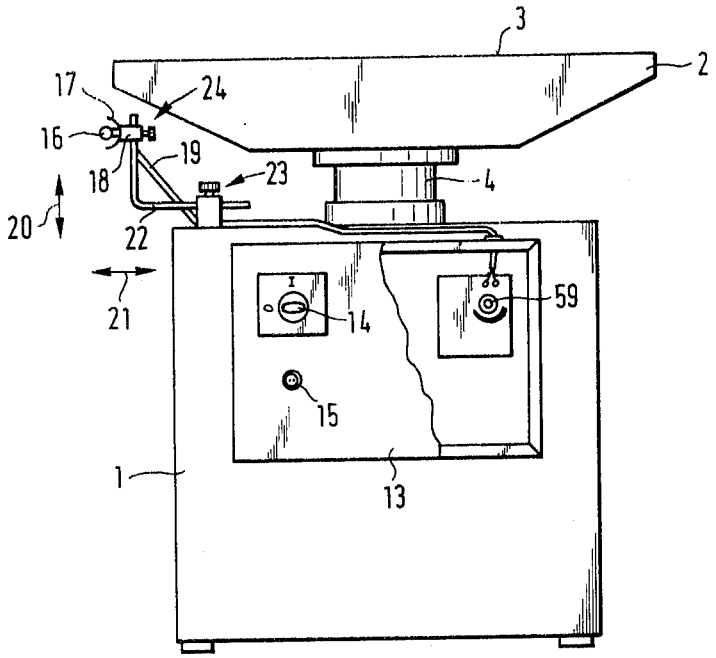

The ironing table shown in FIGS. 1 and 2 is a simple suction table. Provided in the pedestal 1 is a fan 10 with an electric motor 11 to drive it and the intake side of the fan is connected through a duct 12 to the tubular support 4 of the ironing plate 2 in order to draw off any steam produced during use at the appropriately shaped ironing surface 3.

As is the case also in all the remaining embodiments illustrated, the electric switch for the ironing table is mounted in a box 13 on the side of the pedestal 1. In FIG. 2 an external rotary switch 14 is provided on the box 13 as a main switch as well as a socket 15 for connecting the associated iron 9.

To switch on the fan 10 for ironing there is a capacitative proximity switch, to be described later, with a tubular switching arm 16 which extends below the flat ironing surface 3 in the direction of the longitudinal axis of that surface, and in fact it extends over substantially the whole of its length at about the height of the operators thigh. The switching arm 16 is mounted on the pedestal 1.

As shown particularly clearly in FIG. 2, the switching arm 16 is enclosed on that side which is towards the tubular support 4 by a shield 17 of substantially semicylindrical cross-section, which thus exposes only the operative side of the arm 16, namely the front face as shown in FIG. 1 or the left hand side of the arm 16 as shown in FIG. 2, which is towards the operator. The tubular switching arm 16 and the shield 17 are each connected through a respective electric lead 18 or 19 to the above-mentioned capacitative proximity switch or to the electric switching means. Also the switching arm 16 and the shield 17 are adjustable perpendicular and parallel to the ironing surface 3 in the direction of the arrows 20 and 21 in FIG. 2. For this purpose mounting brackets 22 are provided, each secured to the pedestal 1 by a clamping device 23 and to the shield 17 and arm 16 by a clamping device 24.

Figure 3:
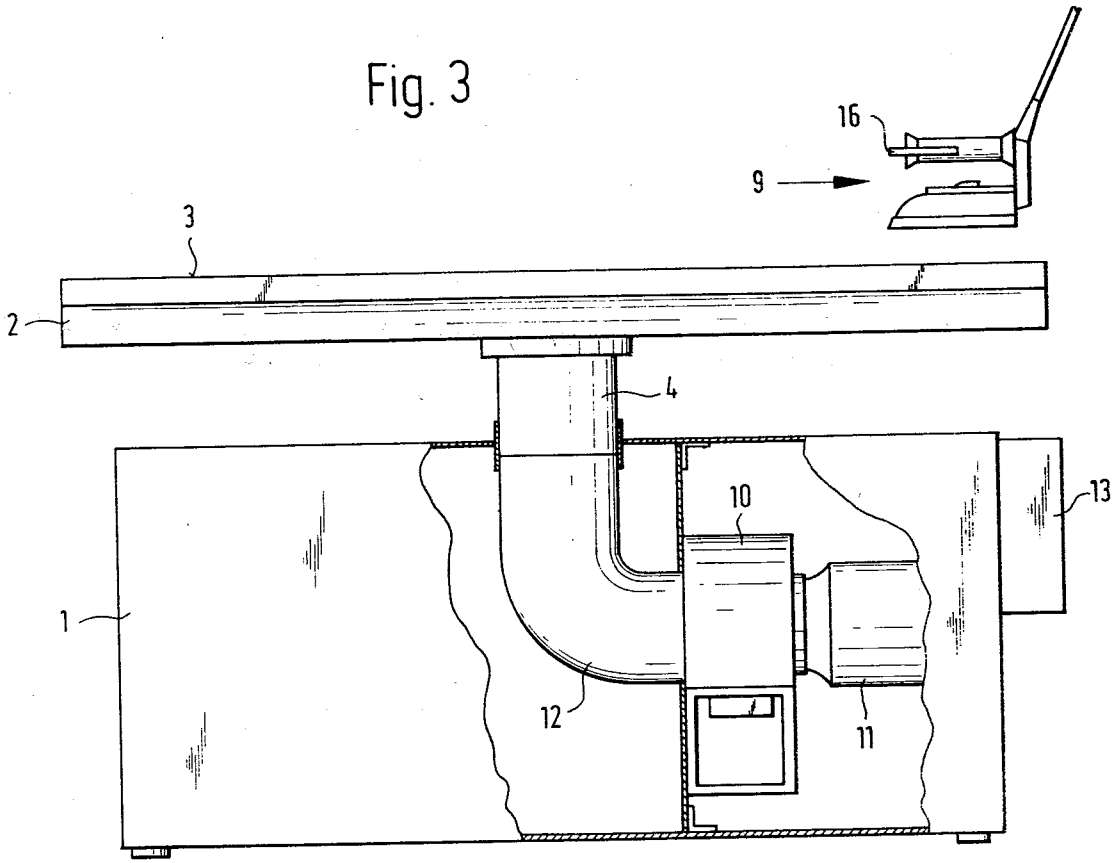
FIG. 3 is a view corresponding to FIG. 1 and showing a modification.

The embodiment shown in FIG. 3 differs from that of FIGS. 1 and 2 only in that the switch arm 16 is mounted not on the pedestal 1 but on the handle of the iron 9 of the table.

Figure 4:
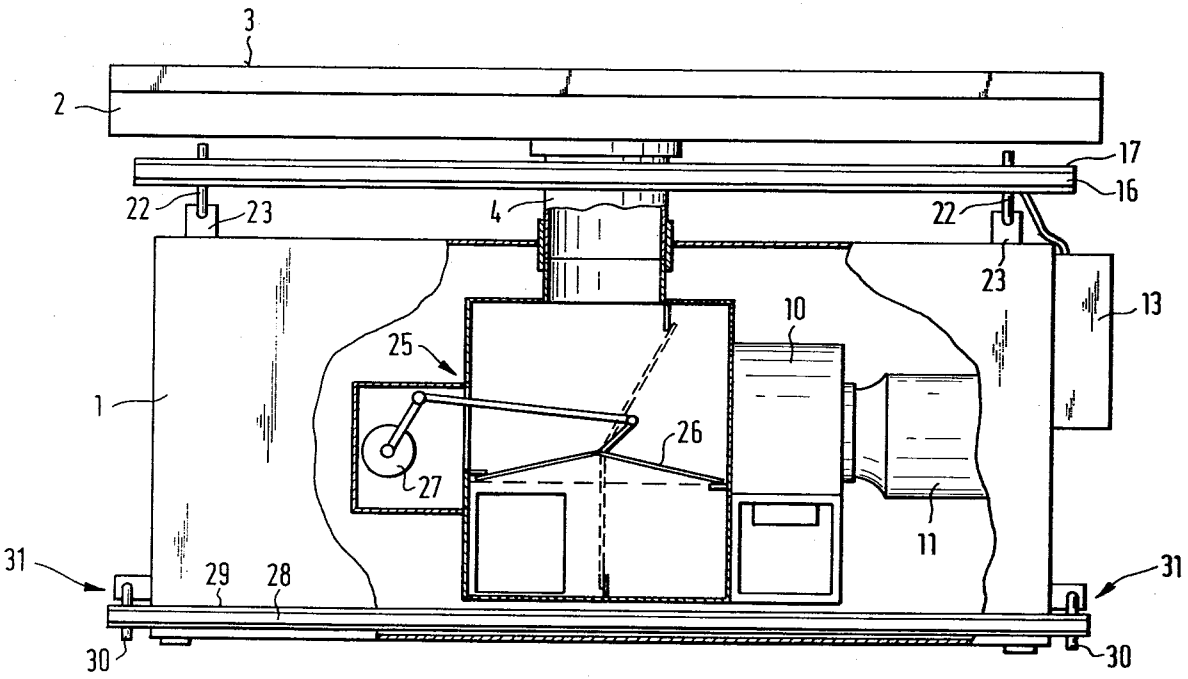
FIGS. 4 and 5 are views corresponding to FIG. 1 and showing a similar ironing table which, however, can be changed over at will from suction operation to blowing operation and includes for this purpose a change-over device or an additional fan for blowing operation.
Figure 5:
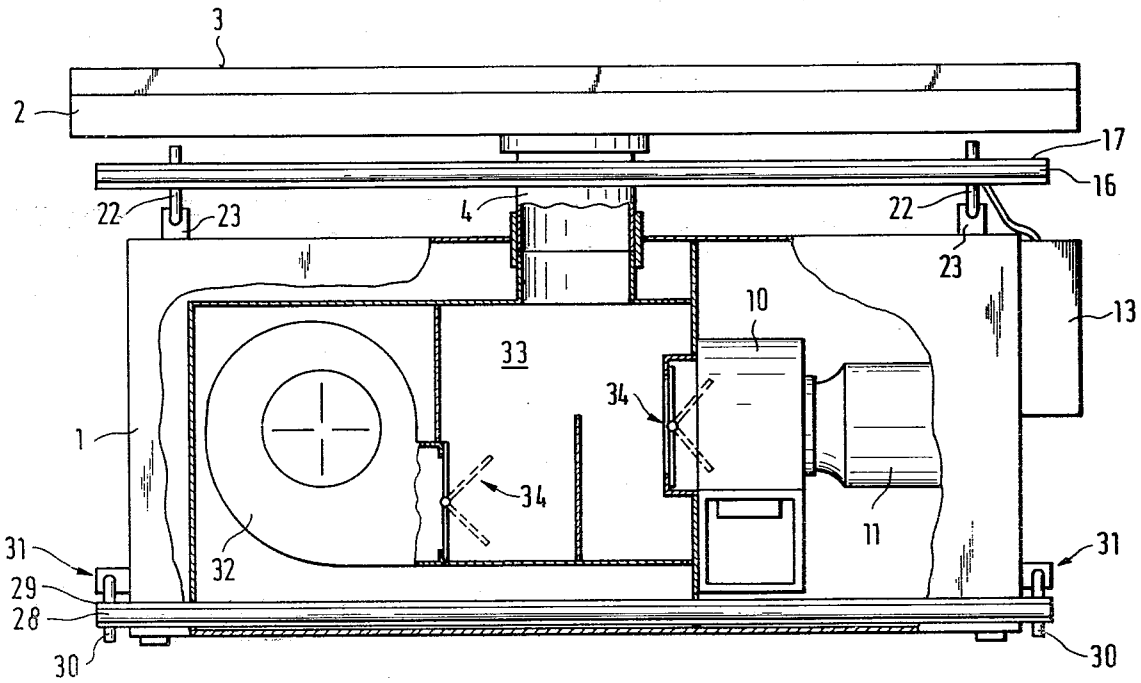

The ironing tables shown in FIGS. 4 and 5 differ from that of FIGS. 1 and 2 substantially in that they can be switched over at will between suction operation and blowing operation. For this purpose, in the embodiment of FIG. 4 there is provided in the pedestal 1 a change-over device 25 which is connected on the one hand to the tubular support 4 for the ironing plate 2 and on the other hand it can be connected at will to the suction side or the delivery side of the fan 10, this being achieved by moving over change-over members, such as for example a flap 26 by means of a rotary electro-magnet 27. The flap 26 when in the position shown in FIG. 4 in full lines, causes suction operation and in the position shown in broken lines it gives blowing operation, the tubular support 4 of the ironing plate 2 being put into communication with the suction side or the delivery side of the fan 10 which itself has its delivery side or suction side open to atmosphere.

In addition to the upper switching arm 16 there is provided a further lower switching arm 28, likewise of tubular form with a shield 29 and likewise mounted adjustably on the pedestal 1 by means of mounting brackets 30 and clamps 31. The second switching arm 28 is associated with a second capacitative proximity switch. The electric connections of the proximity switch are arranged so that when the operator approaches the upper switching arm 16 the above-mentioned suction operation is obtained whereas when the lower arm 28 is approached the stated blowing operation occurs. In both cases, therefore, the fan 10 is switched on and the rotary electro-magnet 27 is energised to set the change-over device 25 to suction or blowing operation.

In the embodiment shown in FIG. 5, instead of the change-over device 25 there is provided in the pedestal 1 in addition to the fan 10, a second fan 32 of which the delivery side leads into a chamber 33 connected to the tubular support 4 of the ironing plate 2 and into which the suction side of the first fan 10 is connected. At the points where the two fans 10 and 32 lead into the chamber 33 there are provided respective baffle plates 34 which open the associated connection, as indicated in broken lines in FIG. 5, when the associated fan 10 or 32 is in operation.

The two fans 10 and 32 can be set in operation only as alternatives, that is to say not simultaneously. The fan 10 is switched on for providing suction at the ironing surface 3 when the operator approaches the upper switching arm 16 and the fan 32 is switched on to apply blowing to the irong surface 3 when the operator approaches the lower switching arm 28.

Figure 6:
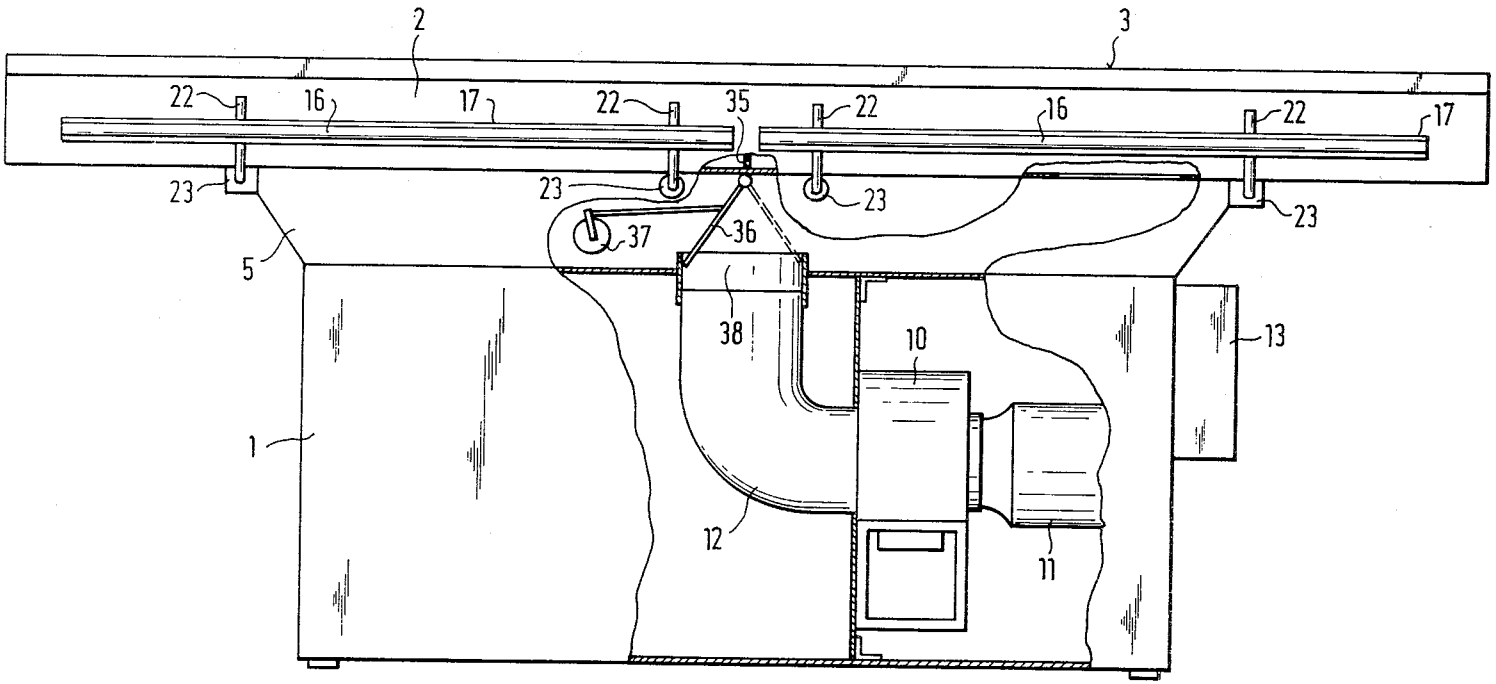
FIGS. 6 to 8 show respectively a front view of an ironing table similar to that of FIGS. 1, 2 or FIG. 4 or FIG. 5 but with a larger flat ironing surface which is divided into two halves which can be individually exposed to suction or air under pressure.
Figure 7:
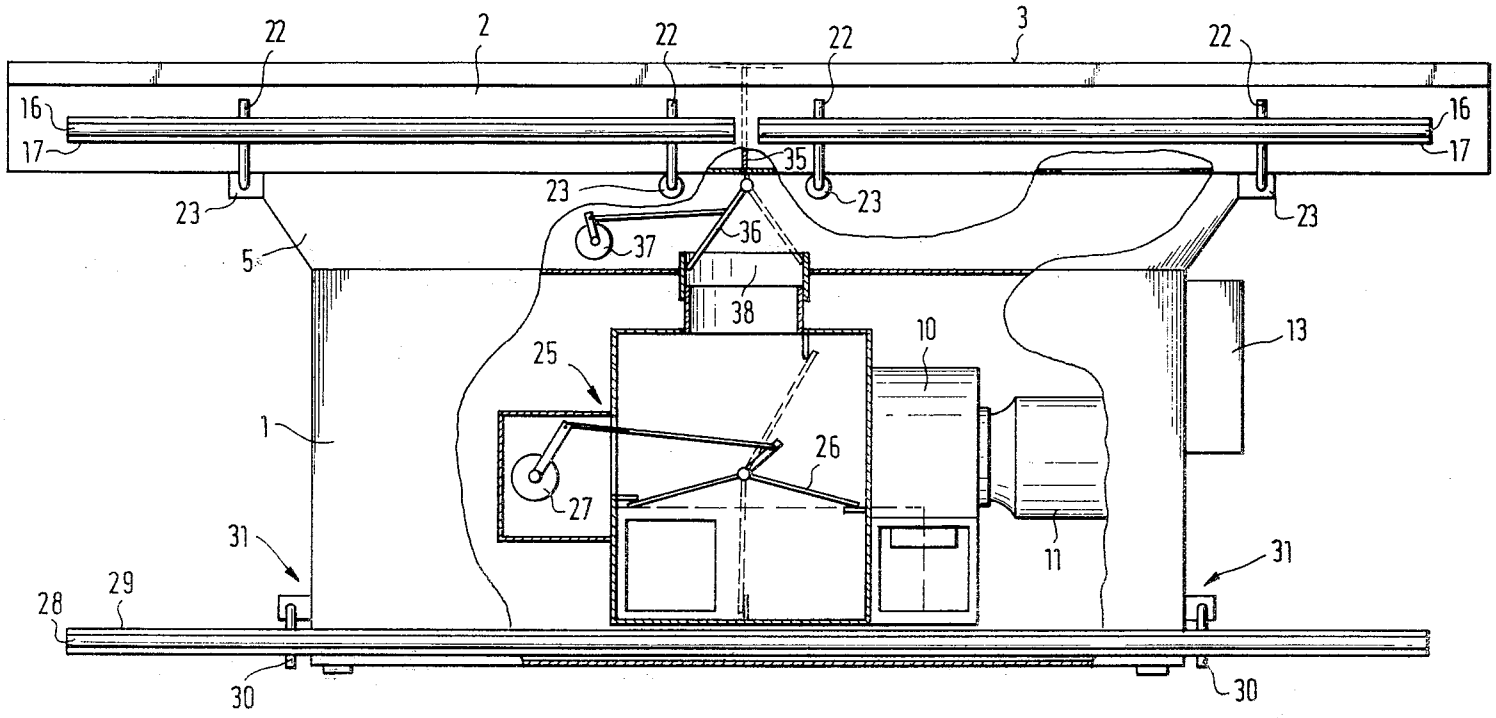
Figure 8:
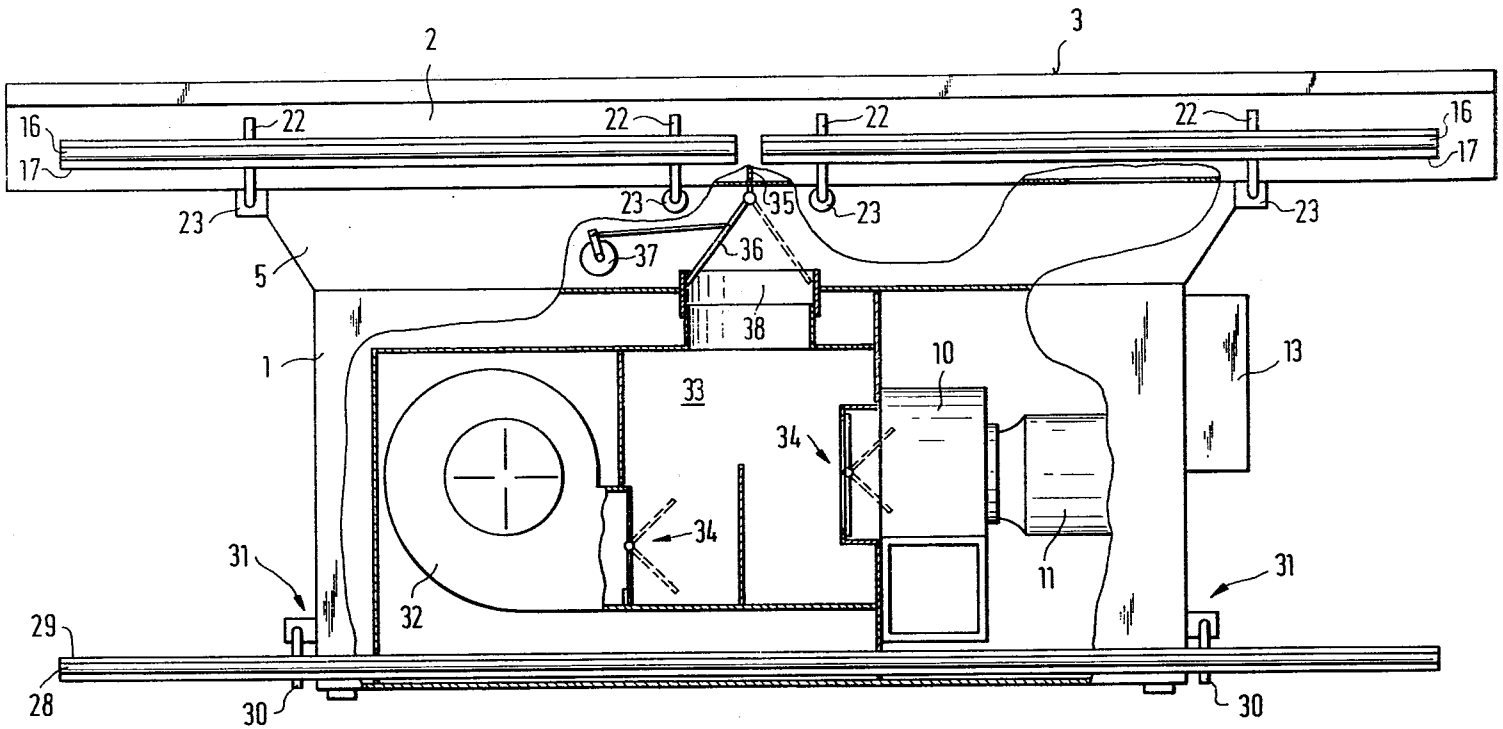

In the embodiments shown in FIGS. 6 to 8 the hollow ironing plate 2 is divided by a wall 35 into two halves and the longitudinal edge of the wall 35 which is towards the hollow intermediate box 5 is provided with a pivoting flap 36 which is moved by a rotary electromagnet 37 between the position shown in full lines and that shown in broken lines, in which the right hand or left hand half of the ironing plate 2 in FIGS. 6 to 8 communicates with an opening 38 in the bottom end of the intermediate box 5. Connected to this in the embodiment of FIG. 6, in a manner analagous to that of FIGS.

1 and 2, is the intake duct 12 of the fan 10 and in the embodiment of FIG. 7, corresponding to that of FIG. 4, the change-over device 25, and the embodiment of FIG. 8, like that of FIG. 5, the chamber 33.

The switching arm 16 and its shield 17 are likewise divided into two halves in the embodiments of FIGS. 6 to 8. In the embodiment of FIG. 6 when the operator approaches tthe left hand half of the arm 16 then suction is applied to the left hand half of the ironing surface 3 whilst when he approaches the right hand half of the arm 16 it is the right hand half of the ironing surface 3 to which suction is applied. In both cases, therefore, the fan 10 is switched on but in addition the rotary electromagnet 37 is energised so that the pivoting flap 36 takes up the position shown in broken lines or in full lines.

Whereas the embodiment shown in FIG. 6 comprises a pure suction ironing table, the tables of FIGS. 7 and 8 can each be switched over at will to suction or blowing operation, corresponding to the embodiments of FIGS. 4 and 5.

Just as in the embodiment of FIG. 6, the embodiments of FIGS. 7 and 8 allow suction on the left hand or right hand half of the ironing surface 3 of the plate 2 when the operator approaches the left hand or right hand half of the switching arm 16. When, on the other hand, blowing operation is esired it is merely necessary to approach the lower switching arm 28. In the embodiment of FIG. 7 this causes actuation of the rotary electromagnet 27 so that the opening 38 is connected to the delivery side of the fan 10 whereas in the embodiment of FIG. 8 it is not the suction fan 10 but on the contrary the blowing fan 32 that is set going.

Also in the embodiments of FIGS. 9 to 14 there are shown suction tables of which the suction fan is switched on by means of a capacitative proximity switch when the operator approaches the tubular switching arm 16 with its shield 17 and which again is adjustable in the manner described above with respect to the pedestal 1 by means of mounting arms 22 and clamps 23 and 24. In addition there is a further proximity switch with a switching arm 39 provided on the handle of the associated iron 9.

In the embodiment of FIGS. 9 to 11 the second proximity switch serves to release the locking of the ironing mandrels 7 to allow them to be turned through 180° about the axis 8. The two mandrels 7 are mounted on a common carrier which is rotatably mounted in the structure 6 to turn about the axis 8 and is rigidly secured to a locking disc 40 provided with two diametrically opposed notches 41 in one of which a detent hook 42 can engage resiliently, as shown in particular in FIG. 11. On actuation of the proximity switch by the switch arm 39 an electro-magnet 43 in the structure 6 is energised to pivot the hook 42 against spring loading, away from the position shown in FIG. 11 so that the disc 40 is freed and the carrier for the ironing mandrels 7 can be rotated by hand.

In the embodiment shown in FIGS. 12 to 14 the proximity switch associated with the switching arm 39 serves to turn the mandrels 7 and their carrier about the axis 8. On actuation of this proximity switch a geared and braked motor 44 is set going to turn the carrier through 180°.

As explained above, steam is used in ironing. Accordingly in FIG. 1 the iron 9 not only has an electric lead 45 to it but also a pipe 46 for water or steam. In order to control the supply of water to the iron 9 and the issue of water vapour from it, a capacitative proximity switch with a switching arm 47 can be provided on the iron 9 and on actuation it allows water or steam to reach the iron 9 so that steam emerges from the iron.

FIG. 15 shown the circuit for a capacitative proximity switch 48 capable of use in accordance with the invention. The switch 48 is made up substantially of two circuits, each containing a coil 49 or 50 and a fixed capacitor 51 or a variable capacitor 52 in parallel with it and coupled together through the coils 49 and 50. The variable capacitor 52 and a resistor 53 shown as connected in series with it represent the switching arm 16 or 28 or 39 or 47. The circuit with the coil 49 and the capacitor 51 is connected to an integrated circuit 54 of which the output is connected to a relay 55 which has a protective diode 56 in parallel with it and which actuates an electric switch 57.

When the operator approaches the switching arm 16, 28, 39 or 47 the capacitance of the capacitor 52 changes, causing the integrated circuit 54 to energise the relay 55 so that this operates to change-over the switch 57. The sensitivity of the capacitative proximity switch 48 can be adjusted by means of a potentiometer 58 which, as shown in FIG. 2, can be adjusted by means of a rotary knob 59 in the box 13. For example the sensitivity can be set so that the switch 48 only acts through the integrated circuit 54 and the relay 55 to change-over the switch 57 when the operator actually touches the arm 16, 28, 39 or 47.

As stated, not only is the switching arm 16 or 28 connected electrically to the associated proximity switch 48 but also the shield 17 or 29. In this way the adjustment of the position of the arm 16 or 28 on the pedstal 1, which takes place together with the associated shield 17 or 29, leaves the electrical characteristics of the associated proximity switch 48 undisturbed.

I claim:

1. An ironing table comprising an ironing surface and a fan for applying suction or blowing air over the ironing surface and a switch to be actuated by an operator for electrically controlling the fan characterized in that the switch is a capacitive proximity switch having a first capacitor element in the form of a rod which extends in front of the ironing table below the ironing surface and is shaped to match the outline of the ironing surface, and a second shield shaped capacitor element of substantially semi-cylindrical cross-section is disposed between the ironing table and the first capacitor element.

2. Ironing table according to claim 1 characterised in that an adjustable potentiometer is provided for adjusting the sensitivity of the capacitative proximity switch (FIG. 15).

3. Ironing table according to claim 1 or 2 characterised in that the capacitative proximity switch is connected to at least one relay (FIG. 15).

4. Ironing table according to claim 1 or 2 characterised in that the switching arm is provided with a shield exposing only the operative side.

5. Ironing table claim 1 or 2 characterised in that the switching arm extends below the ironing surface in the longitudinal direction of the latter.

6. Ironing table according to claim 5 with a pedestal and an upper ironing plate or ironing hood with an ironing surface detachably connected to the pedestal, characterised in that the switching arm is mounted on the pedestal.

7. Ironing table according to claim 6 characterised in that the switching arm is adjustable perpendicular and/or parallel to the ironing surface.

8. Ironing table according to claim 6 or 7 characterised in that the switching arm is shaped to match the outline of the ironing surface.

9. Ironing table according to claim 1 or 2 in combination with an iron for pressing characterised in that the switching arm is provided on the iron.

10. Inroning table according to claim 1, 2, 6 or 7 with a fan for applying suction and a fan for applying blowing to the ironing surface, characterised in that for each fan there is provided a separate capacitative proximity switch or a further electric switch which is actuated to connect the first capacitative proximity switch to one or the other fan.

11. Ironing table according to claim 1 or 2 in combination with a fan and with means for changing the fan to apply suction or to blow air to the ironing surface, characterised in that two capacitative proximity switches are provided for switching on the fan and change to suction or blowing or a capacitative proximity switch for switching on the fan and an electric switch for actuating the change-over device for changing over between suction and blowing operation.

12. Ironing table according to claim 1 or 2 in combination with the ironing surface divided into more than one suction or blowing region which can be individually connected to the fan, characterised in that each region has at least one separate capacitative proximity switch associated with it.

13. Ironing table according to claim 1 or 2 and provided with two horizontal ironing mandrels which are rotatable individually about their longitudinal axis or together about a central longtudinal axis and means for locking said mandrels in their angular positions, characterised by a capacitative proximity switch for switching on a rotary drive for the mandrels or for unlocking the mandrels.

14. Ironing table according to claim 1 or 2 in combination with a water or steam iron, characterised by a capacitative proximity switch for controlling the supply of water or steam to the iron, or which the switching arm is provided on the iron.

15. The ironing table of claim 1 wherein the first and second capacitor elements are adjustable vertically and horizontally with respect to the said ironing surface.

16. An apparatus for pressing cloth and the like with a heated ironing device comprising a surface for supporting the cloth, electrically driven means for moving air over the cloth while supported on the surface, and switch means for controlling flow of electricity for activating said means for moving air comprising a first capacitor disposed below and in front of said surface for supporting the cloth and having a contour substantially like that of the said surface, and a second capacitor having a semi-cylindrical cross-section which is disposed between the first capacitor and said surface.

* * * * *